US007118515B2

(12) United States Patent
Kassel et al.

(10) Patent No.: US 7,118,515 B2
(45) Date of Patent: Oct. 10, 2006

(54) EXERCISING DEVICE

(76) Inventors: Arthur Michael Kassel, 511 N. Foothill, Beverly Hills, CA (US) 90210; Kenneth Owen Richardson, P.O. Box 2254, Whittier, CA (US) 90610

( * ) Notice: Subject to any disclaimer, the term of this patent is extended or adjusted under 35 U.S.C. 154(b) by 0 days.

(21) Appl. No.: 11/123,577

(22) Filed: May 6, 2005

(65) Prior Publication Data

US 2005/0209063 A1 Sep. 22, 2005

Related U.S. Application Data

(63) Continuation of application No. PCT/US03/35375, filed on Nov. 5, 2003.

(60) Provisional application No. 60/425,181, filed on Nov. 8, 2002.

(51) Int. Cl.
*A63B 22/06* (2006.01)
*A63B 22/12* (2006.01)
*A63B 69/16* (2006.01)

(52) U.S. Cl. ..... 482/57; 482/62

(58) Field of Classification Search ..... 482/57, 482/60, 62, 79, 80, 904; 601/26, 35
See application file for complete search history.

(56) References Cited

U.S. PATENT DOCUMENTS 1,386,206 A * 8/1921 Samuelson ..... 482/62
1,409,992 A * 3/1922 Armstrong ..... 482/62
2,484,153 A * 10/1949 Chaudoir, Sr. ..... 482/60
3,058,742 A * 10/1962 Jaffe ..... 482/60
4,169,591 A * 10/1979 Douglas ..... 482/58
4,773,399 A 9/1988 Richardson
4,869,494 A 9/1989 Lambert, Sr.
4,902,002 A * 2/1990 Huang ..... 482/62
4,973,046 A * 11/1990 Maxwell ..... 482/60
5,284,131 A 2/1994 Gray
5,343,856 A * 9/1994 Proctor ..... 601/35
5,518,476 A * 5/1996 McLeon ..... 482/79
5,586,961 A * 12/1996 Quint ..... 482/111
6,106,440 A 8/2000 Olbrish, Jr.

FOREIGN PATENT DOCUMENTS

WO WO 2004/050190 A1 6/2004

* cited by examiner

*Primary Examiner*—Stephen R. Crow
*Assistant Examiner*—Tam Nguyen
(74) *Attorney, Agent, or Firm*—Howard M. Cohn

(57) ABSTRACT

An exercising device is described that permits exercising the arms and/or legs of a person, such as a wheelchair-bound person. The device has a drive shaft to which foot pedals are mounted. The foot pedals are mounted off of the axis of rotation and at an angle to the axis of rotation such that when a person's feet are strapped to the foot pedals and the drive shaft is rotated, the feet will circle the axis of rotation and will cause circular motion of the ankles. Arm exercising members are attached to the drive shaft will cause an oscillatory pivotal motion of the arm exercising members.

20 Claims, 4 Drawing Sheets

EXERCISING DEVICE

CROSS-REFERENCE TO RELATED APPLICATIONS

This application claims the benefit of U.S. Provisional Patent Application No. 60/425,181 filed on Nov. 8, 2002 which is incorporated herein by reference.

This application is a continuation of copending PCT Patent Application No. PCT/US2003/35375 filed on Nov. 5, 2003, which is incorporated herein by reference.

TECHNICAL FIELD OF THE INVENTION

The present invention relates generally to exercising devices and more particularly to an exercising machine for use by a person that is not otherwise able to exercise their limbs by voluntary extension or contraction of their muscles.

BACKGROUND

It has long been known that for individuals who have limited mobility of their limbs, regular exercise can provide significant benefits. Such individuals, who may have suffered a spinal injury, stroke, multiple sclerosis (MS), muscular dystrophy (MD), or other similar injury or disorder that impairs mobility (either temporarily or permanently), may also find that their impairments can even present significant obstacles to exercising other relatively unaffected body parts.

Regular movement of all major body parts has been shown to be necessary to promote the comfort, health and general well-being of individuals suffering from such disabilities. A failure to do so can have painful, even unhealthful and dangerous consequences. For example, immobility tends to lead rapidly to stiffened and painful joints and tendons. In the longer term, atrophy of unusused and underused muscles can occur. A greater susceptibility to the formation of blood clots has been demonstrated. Long-term immobility also leads to an overall deterioration of the cardiovascular system.

By way of contrast, when impaired limbs are regularly exercised (e.g., when subjected to repeated manual extensions by a physical therapist), joints tend to become more flexible, circulation is improved, the tendency to atrophy is reduced, the heart tends to work more efficiently, and the patient tends to experience less pain and discomfort. While the benefit of such exercise is indisputable, it can require considerable time and effort of both the afflicted individual and the assistant (therapist or volunteer). In some cases, truly effective exercise of a disabled person can tax the limits of strength and stamina of the assistant.

In response, several mechanical and electromechanical devices have been designed to help in providing a practical means by which a disabled person can exercise relatively unassisted. While beneficial in many ways, these devices often have their limitations. For example, U.S. Pat. No. 4,773,399 ('399), entitled EXERCISING DEVICE, issued to Kenneth O. Richardson, describes a device for exercising the arms and legs of a person who otherwise has difficulty moving these limbs. While the exercising device disclosed in the '399 patent has proven effective, it does not afford motion of the feet comparable to that which would be achieved in walking.

SUMMARY OF THE INVENTION

The present invention provides a device for exercising the feet, arms and legs of a person in a seated position, such as a wheelchair-bound person. The device is adapted to repeatedly extend the legs and arms of the person and to impart a circular, rotational motion to the ankles. A motor drive unit provides for powered rotation of a drive shaft that controls and coordinates all of the various motions.

According to the invention, the device has an elongated rotatable drive shaft. The drive shaft is bent to form two support arms off of a rotational axis of the drive shaft (i.e., crank arms). Two pedal plates are each rotatably mounted to a respective support arm. Preferably the support arms are positioned 180 degrees apart from one another with respect to the rotational axis of the drive shaft. The support arms are also "canted" at an angle with respect to the axis of rotation, preferably at an angle between 5 and 25 degrees and more preferably at an angle between 10 and 20 degrees.

This "cant" angle causes the imparts a circular, rotational motion to the pedal plates (when a person' feet are strapped to the plates), thereby imparting a repeated circular, rotational motion to the person's feet and ankles.

According to an aspect of the invention, the pedal plates can be pivotally mounted to a bushing which is in turn rotatably mounted to the support arm.

Preferably, the device includes a frame to which major components of the device are mounted. This frame includes a platform section onto which a wheelchair can be rolled. Alternatively, a chair, stool or bench can be provided on the platform section.

According to another aspect of the invention, a pair of arm exercising members are pivotally mounted to the frame of the device and linked to the drive shaft such that rotation of the drive shaft causes oscillatory motion of the crank arms. The crank arms include handle portions to be gripped by the person using the device.

When using the device, rotation of the drive shaft causes repeated extension and retraction of a persons arms and legs, as well as rotation of the ankles, thereby imparting a wide range of motions similar to those that might be experienced while walking.

BRIEF DESCRIPTION OF THE DRAWINGS

These and other features of the present invention will be apparent with reference to the following description and drawings wherein.

DETAILED DESCRIPTION OF THE INVENTION

Figure 1:
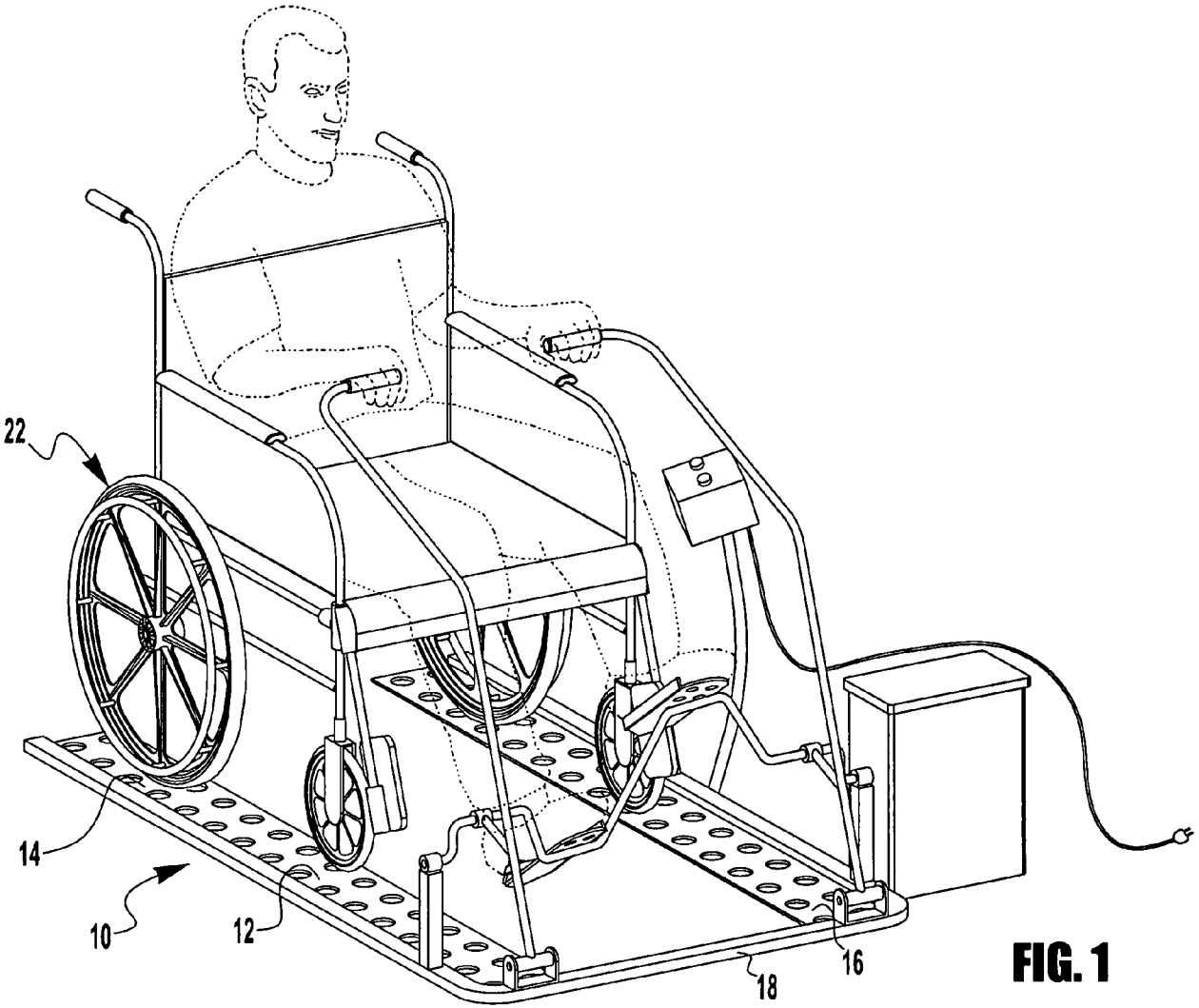
FIG. 1 is a perspective view of the exercising device of the present invention.
Figure 2:
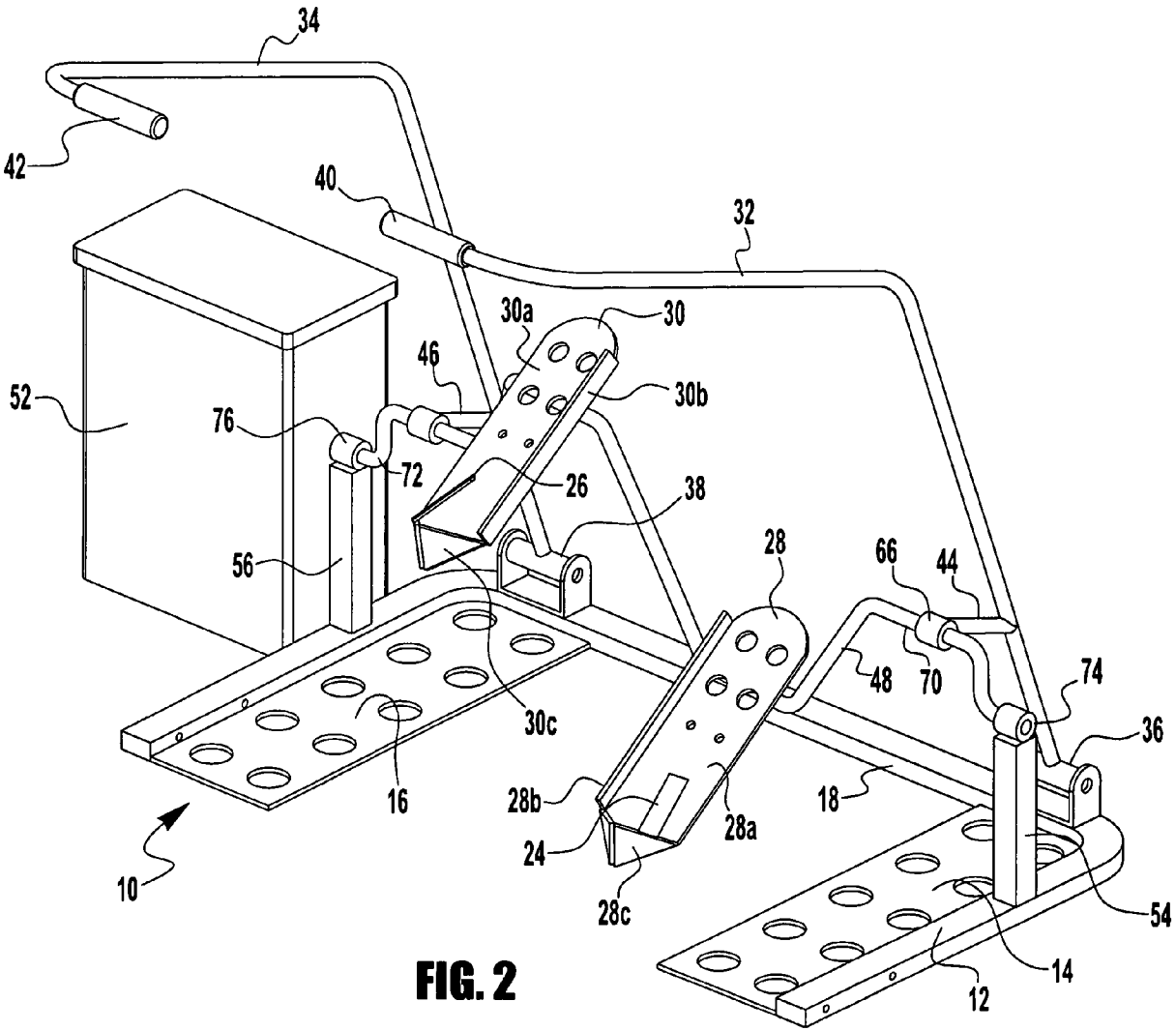
FIG. 2 is an enlarged, perspective view of the exercising device shown in FIG. 1.
Figure 3:
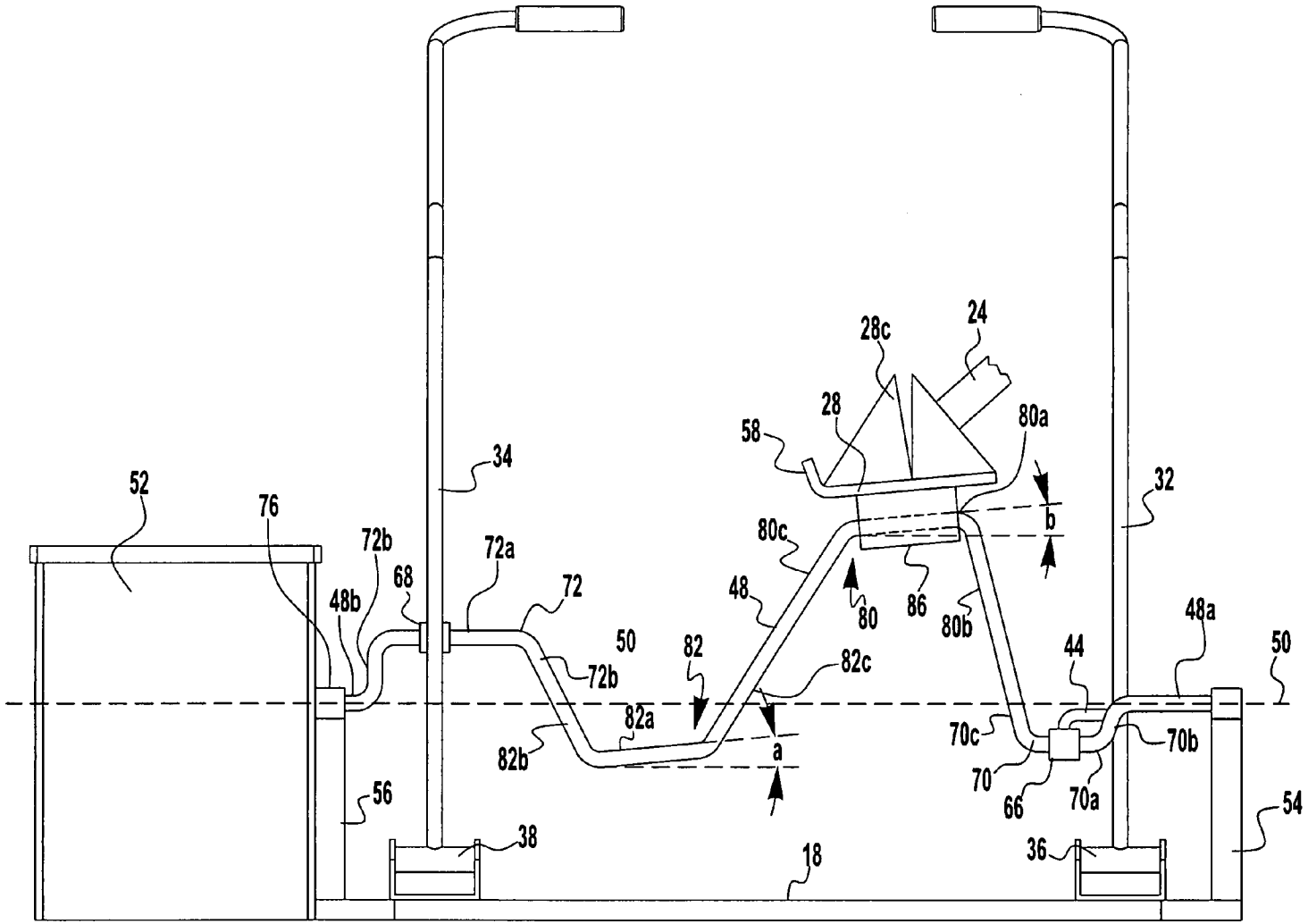
FIG. 3 is a front elevational, partially cut away view of the device shown in FIGS. 1 and 2.

The exercising device 10, shown in FIGS. 1, 2 and 3, includes a frame 12, which is in turn made up of a pair of platforms 14, 16, and a rail 18. A wheelchair 22 rests on the platforms 14, 16 and may be positioned at any comfortable location and locked in place by a brake (not shown) on the wheelchair. The wheelchair 22 may be replaced by any type of chair, stool or bench. The patient sitting in the wheelchair can then be strapped by foot straps 24, 26 onto pedal plates 28, 30 in any desired manner to secure the shoes or feet of the patient onto the pedal plates 28, 30.

Arm exercising members 32, 34 are pivotally connected at pivot points 36, 38 to rail 18 and include a pair of handles 40, 42. Arm exercising members 32, 34 are caused to oscillate back and forth by movements transmitted via a pair of link arms 44, 46, which are connected between the arm exercising members and a shaft 48 that is rotated about an axis of rotation or centerline 50 by a motor drive device 52. The shaft 48 is rotatably supported by shaft supports 54, 56, which are attached to the rail 18, as best shown in FIG. 2.

As shown in FIGS. 2 and 3, the foot pedal plates 28, 30 each have a respective flat base 28*a*, 30*a* with upstanding side foot guards 28*b*, 30*b* along inner edges thereof, (corresponding to the inner side of the patient's feet) to keep the feet on the foot pedals as they rotate. Also, heel supports 28*c*, 30*c* allow the patient's feet/shoes to rest securely on the pedals 28, 30 so that they can be strapped in with straps 24, 26. Although one strap is shown with each pedal 28, 30, it is within the spirit and scope of the invention to have additional straps and/or foot/shoe locking clamps.

The links 44 and 46, which are connected to the arm exercising members 32 and 34, respectively, are rotatably attached to the shaft 48 by the bearings 66, 68 to generally u-shaped sections 70, 72 of the shaft 48 so that when the shaft rotates about the center line 50 (rotational axis of the shaft 48), as discussed hereinafter, the arm exercising members 32, 34 move back and forth alternately about pivot points 36 and 38.

The present invention is particularly directed to the shape of the drive shaft 48. Opposite ends of the drive shaft, 48*a* and 48*b*, are each rotatably connected to the shaft supports 54, 56 by bushings 74, 76 to allow the drive shaft 48 to be rotated about the axis of rotation 50 by the motor drive device 52. The ends 48*a*, 48*b* of the drive shaft 48 are connected with the u-shaped bends or bent sections 70, 72. Bearings 66, 68, are rotatably secured to the u-shaped sections, as described hereinabove. Note that he u-shaped bent sections 70, 72 are oriented 180 degrees apart from one another with respect to rotation about the centerline 50. While the bent sections 70, 72 are called u-shaped, they have central sections 70*a*, 72*a* which are both disposed parallel to the center line 50 and arm sections 70*b*, 70*c*, 72*a*, 72*b*, respectively, that extend outward at a range of desired angles with respect to the centerline 50 to connect them to the ends 48*a*, 48*b* of the shaft and to pedal connect sections 80, 82 of the drive shaft 48.

The pedal connect section 80 includes a central support arm 80*a* and two side arms 80*b*, 80*c*. Similarly the pedal connect section 82 includes a central support arm 82*a* and two side arms 82*b*, 82*c*. The side arms 80*b* and 82*b* join with the side arms 70*c* and 72*b* of the u-shaped bends 70 and 72, respectively. The side arms 70*c* and 72*b* of the bends 80 and 82, respectively, join with each other at approximately the centerline 50 of the drive shaft 48.

A key aspect of the present invention relates to the support arm 80*a* and 82*a* of support sections 80 and 82 and their position with respect to the center line 50. That is, the support arms 80*a* and 82*a* are disposed at angles b and a, respectively, with respect to the center line 50. Preferably, the angles a and b are identical so that the support arms 80*a* and 82*a* are parallel to each other. The angles a and b are preferably between about 5 and 25 degrees, and more preferably between 10 and 20 degrees. Also, the support arms 80*a* and 82*a* are disposed 180 degrees apart from each other with respect to rotation about the centerline 50. The position of the support arms 80*a* and 82*a* disposes the pedals 28 and 30, as discussed in more detail below, at a corresponding angle to the center line 50 which has very great benefits to the operator of the device. Each of the pedals, 28, 30 is attached to an axle 48 at the support arms 80*a*, 82*a* by bushings 86, 88. In FIG. 3, only one pedal (28) is shown; the other pedal (30, see FIG. 2) has been omitted for illustrative clarity. The other pedal (30) is similar in structure to the shown pedal, having a similar bushing arrangement. The bushings 86,88 have a cylindrical bore extending therethrough to receive the shaft 48 so that the pedals 28 and 30, respectively, can freely spin about the support arms 80*a* and 82*a* of the pedal connect sections 80 and 82, respectively. Optionally, the bushings 86, 88 can be formed of several elements that are secured together by any desired means to enable them to be easily attached to or removed from the axle. 48 as needed.

During operation, the drive shaft 48 is rotated by the motor drive device 52 at any desired speed causing the pedals to move in a circular rotation about the centerline 50. Due to the angle that the foot plates 28, 30 are disposed with respect to the center line of rotation 50, a patient's foot secured firmly onto the foot plate will move both forward and backward as well as in a rotational motion of the foot and ankle due to the angles a and b with which the foot plates 28, 30 are disposed with respect to the center line 50.

Referring to FIG. 3, when the drive shaft 48 is rotated (about centerline 50) so that the foot plate 28 is at its rearmost position (with respect to a front portion of rail 18), the foot plate 28 is oriented such that its right side is farther back than its left side. However, when the axle 48 rotates 180 degrees about centerline 50 to its frontmost position, the foot plate 28 is oriented so that the right side is farther forward than its left side. Foot plate 30 (not shown in FIG. 3) undergoes a similar motion. This produces rotation of the feet and ankles (of a patient whose feet are strapped to the foot plates 28, 30) as the drive shaft 48 is rotated about its centerline 50.

The advantages of this synchronized movement in conjunction with the arm exercising members imitates walking in a synchronized movement, thereby increasing mobility, muscle tone and maintaining a range of motions for the limbs. Further, this function helps to re-educate the brain by finding new neural pathways for people with spinal cord and traumatic head injuries. Other advantages of the machine are to help eliminate poor circulation, spasticity, stiff joints, muscle atrophy and swelling ankles. This is particularly important to help eliminate contractures and give an individual more freedom of movement after sitting for long periods of time in a wheelchair.

Figures 4, 5:
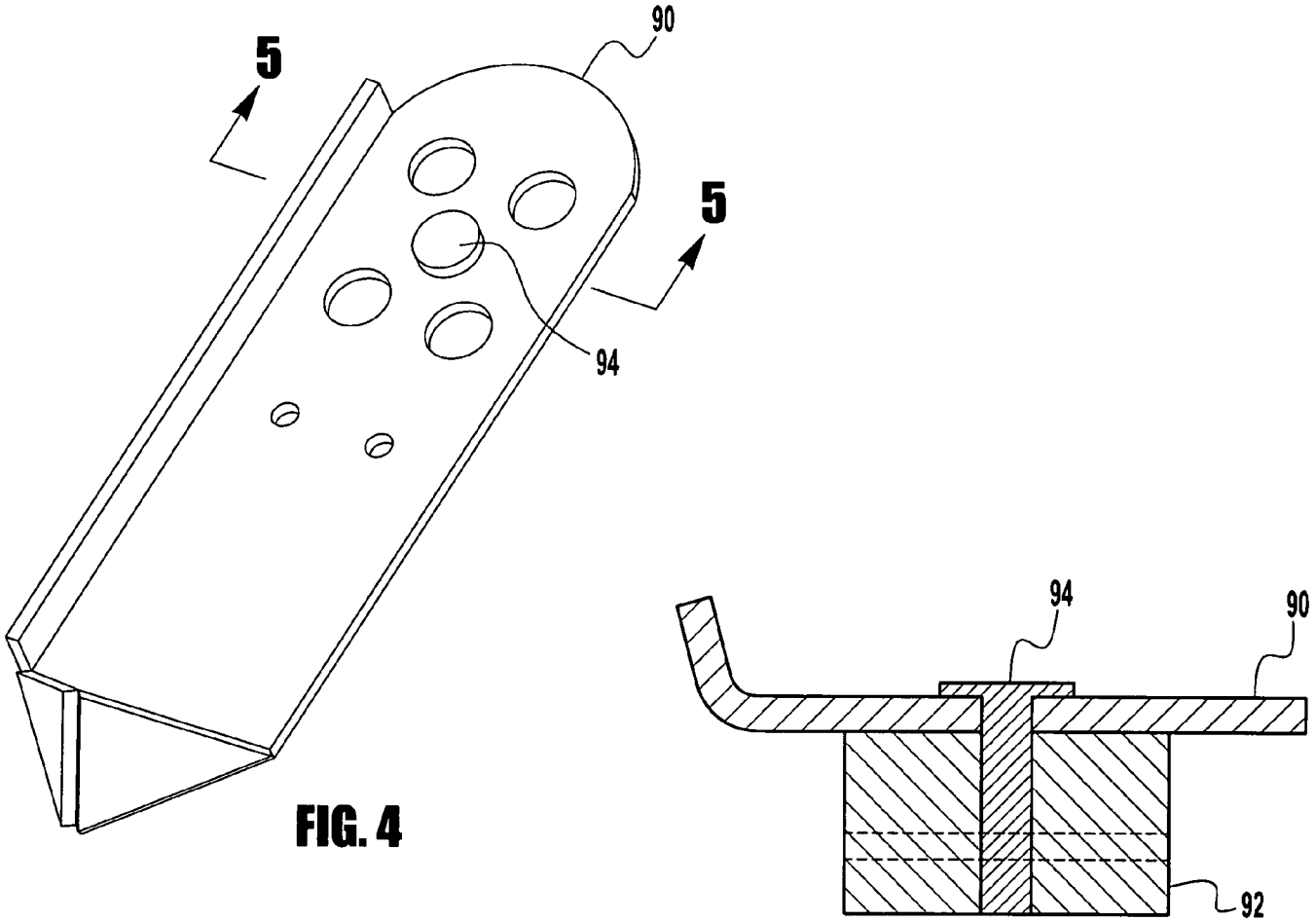
FIG. 4 shows a top view of an alternative embodiment of a pedal plate attached to a bushing.
FIG. 5 shows a cross-sectional view through line 5—5 of the pedal plate shown in FIG. 4.

In an alternative embodiment shown in FIGS. 4 and 5, a foot pedal 90 (corresponding to foot pedal 28) is pivotally mounted to a bushing 92 (corresponding to bushing 86) so that it can pivot with respect to the upper surface of the bushing 92. For example, a bolt 94 can be disposed through the foot plate whereby an additional pivotal movement is available in the plane of the surface of the pedal 90 to help further increase the range of motion of a person's foot and ankle.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, circuits, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

What is claimed is:

1. A device for exercising a person's feet and legs, the device comprising:

an elongated rotatable shaft, having an axis of rotation, with first and second foot pedals rotatably attached to first and second spaced-apart support sections of the shaft; each support section having a support arm disposed at an angle relative to the axis of rotation whereby the support arms of each support section are parallel to each other but not parallel to the axis of rotation; and the foot pedals are rotatably attached to each support arm and adapted to move a person's feet both forward and backward as the shaft rotates about the axis of rotation while simultaneously causing a rotational motion of the foot and ankle due to the angle of the support arms with respect to the axis of rotation.

2. The device according to claim 1 wherein:

each foot petal is pivotally mounted to a bushing that is rotatably mounted to a respective support arm.

3. A device according to claim 1, wherein:

the support arms are disposed 180 degrees apart from one another with respect to rotation about the axis of rotation of the shaft.

4. A device according to claim 1, wherein:

the angle defined between the support arms and the axis of rotation is between 5 and 25 degrees.

5. A device according to claim 4, wherein:

the angle defined between the support arms and the axis of rotation is between 10 and 20 degrees.

6. A device according to claim 1, further comprising:

a frame including a platform for supporting a wheelchair.

7. A device according to claim 1, further comprising:

a pair of arm exercising members, each pivotally mounted to a frame portion of the device and linked to the shaft such that motion of the arm exercising members is synchronized to rotation of the shaft.

8. A device according to claim 1, further comprising:

a motor drive device for rotating the shaft about its axis of rotation.

9. A device for exercising, comprising:

a frame including a platform section;

a drive shaft having an axis of rotation and a pair of spaced-apart support arms orientated at an angle relative to the axis of rotation to the axis of rotation, and a pair of link arms pivotally connected to the drive shaft;

a pair of arm exercising members, pivotally connected to the frame and connected to the link arms such that rotational motion of the drive shaft about its axis of rotation causes oscillating pivotal motion of the arm exercising members; and a foot pedal rotatably attached to each support arm adapted to move a foot of a person both forward and backward as the shaft rotates about the axis of rotation while simultaneously causing a rotational motion of the foot and ankle due to the angle of the support arm with respect to the axis of rotation.

10. A device according to claim 8, wherein:

the foot pedals are each pivotally mounted to a respective bushing which is in turn rotatably mounted to a respective support arm.

11. A device according to claim 9, wherein:

the angle at which each support arm is oriented with respect to the axis of rotation is between 5 and 25 degrees.

12. A device according to claim 11, wherein:

the support arms are parallel to one another.

13. A device according to claim 11, wherein:

the angle at which each support arm is oriented with respect to the axis of rotation is between 10 and 20 degrees.

14. A device according to claim 13, wherein:

the support arms are parallel to one another.

15. A device according to claim 9, further comprising:

a motor drive device for rotating the drive shaft about its axis of rotation.

16. A device for exercising, comprising:

a frame including a platform section;

a drive shaft having an axis of rotation and a pair of spaced-apart support arms orientated at an angle relative to the axis of rotation to the axis of rotation, and a pair of link arms pivotally connected to the drive shaft;

a motor drive device for rotating the drive shaft about its axis of rotation;

a pair of arm exercising members, pivotally connected to the frame and connected to the link arms such that rotational motion of the drive shaft about its axis of rotation causes oscillating pivotal motion of the arm exercising members; and a foot pedal rotatably attached to each support arm is adapted to move a person's foot both forward and backward as the shaft rotates about the axis of rotation while simultaneously causing a rotational motion of the foot and ankle due to the angle of the support arm with respect to the axis of rotation; wherein:

the support arms are parallel to one another;

the support arms are positioned 180 degrees apart from one another with respect to rotation about the axis of rotation; and the angle at which each support arm is oriented with respect to the axis of rotation is between 5 and 25 degrees.

17. A device according to claim 16, wherein:

the angle at which each support arm is oriented with respect to the axis of rotation is between 10 and 20 degrees.

18. A device according to claim 16, wherein:

the foot pedals are each pivotally mounted to a respective bushing which is in turn rotatably mounted to a respective support arm.

19. A device according to claim 16, wherein:

the angle at which each support arm is oriented with respect to the axis of rotation is between 10 and 20 degrees; and the foot pedals are each pivotally mounted to a respective bushing which is in turn rotatably mounted to a respective support arm.

20. A device according to claim 19, wherein:

each of the foot pedals have a foot strap to secure shoes.

* * * * *

UNITED STATES PATENT AND TRADEMARK OFFICE

CERTIFICATE OF CORRECTION

PATENT NO. : 7,118,515 B2
APPLICATION NO. : 11/123577
DATED : October 10, 2006
INVENTOR(S) : Kassel et al.

It is certified that error appears in the above-identified patent and that said Letters Patent is hereby corrected as shown below:

Column 5, Claim 9, line 56: delete “orientated”, insert --oriented--
Column 5, Claim 9, line 57: delete “to the axis of rotation” - the wording is in there twice
Column 6, Claim 16, line 26: delete “orientated”, insert --oriented--
Column 6, Claim 16, line 27: delete “to the axis of rotation” - the wording is in there twice Signed and Sealed this Nineteenth Day of December, 2006

JON W. DUDAS
*Director of the United States Patent and Trademark Office*